United States Patent [19]

Byers

[11] 4,229,895

[45] Oct. 28, 1980

[54] OSCILLATING PLATE ANIMATED MOTION DISPLAY MACHINE

[76] Inventor: Thomas L. Byers, 3000 SW. 60, Oklahoma City, Okla. 73159

[21] Appl. No.: 970,677

[22] Filed: Dec. 18, 1978

Related U.S. Application Data

[63] Continuation-in-part of Ser. No. 807,716, Jun. 17, 1977, Pat. No. 4,132,021.

[51] Int. Cl.[3] ..... G09F 19/00

[52] U.S. Cl. ..... 40/614; 40/429; 46/126

[58] Field of Search ..... 40/614, 414; 46/126, 46/138

[56] References Cited

U.S. PATENT DOCUMENTS

| | | | |
|---|---|---|---|
| 1,640,909 | 8/1923 | Schutz | 40/614 |
| 2,530,404 | 11/1950 | Seares | 40/614 |
| 2,646,639 | 7/1953 | Toth | 40/614 |
| 2,932,919 | 4/1960 | Evans | 40/614 |
| 3,024,551 | 3/1962 | Oppenheim | 40/614 |
| 3,477,157 | 11/1969 | Paquette | 40/614 |
| 3,888,030 | 6/1975 | Bradt | 40/614 |
| 4,123,865 | 11/1978 | Pearson | 40/414 |
| 4,132,021 | 1/1979 | Byers | 40/614 |

*Primary Examiner*—Louis G. Mancene
*Assistant Examiner*—Wenceslao J. Contreras
*Attorney, Agent, or Firm*—Robert K. Rhea

[57] ABSTRACT

A base supported upright frame supports an electric motor and gear train having a vertically disposed drive shaft. The drive shaft is axially connected by brackets, stub axle and bearings with a nonrotating swash plate. An elongated strand, connected at one end with a radial portion of the plate and entrained over one or more pulleys, is connected at its other end with an element to be animated by the plate moving the strand in a vertical reciprocating action.

6 Claims, 5 Drawing Figures

OSCILLATING PLATE ANIMATED MOTION DISPLAY MACHINE

BACKGROUND OF THE INVENTION

1. Field of the Invention.

The present invention relates to display advertising and more particularly to an apparatus for imparting animation to articles on display.

In the field of retail advertising displays are often animated to attract the attention of customers and/or demonstrate the use or operation of the product for sale.

2. Description of the Prior Art.

Heretofor animated advertising displays have usually been accomplished by the use of a relatively small electric motor arranged for imparting motion to the article or articles displayed. These little motors usually have a relatively short life span and, if battery operated, are frequently subject to maintenance problems, such as replacing the batteries. Frequently the motor and its drive components are custom made for the particular type of display to be animated and are seldom reuseable in other displays thus adding to the initial cost of producing an animated display.

Prior patents, such as U.S. Pat. Nos. 2,646,639; 2,932,919 and 3,024,551 have generally employed a crank shaft so that the throw of the crank shaft or a cam thereon imparts reciprocating movement to articles connected by strands to the crank shaft. Other patents, such as U.S. Pat. No. 1,640,909 have utilized eccentric disks contacting an intermediate portion of a display supporting strand to impart movement to the display.

The principal disadvantage of the devices of these named patents is that excessive wear occurs at the point of contact or attachment of the strand to the motion imparting member.

This invention is distinctive over these patents by utilizing a nonrotating oscillating plate mounted on a vertical axis so that animated motion inducing strands connected therewith are not subjected to sliding friction wear intermediate their ends.

This invention is similarly distinctive over my copending application by eliminating the sliding friction contact between animated motion inducing strands passing through apertures when connected with a crank member.

SUMMARY OF THE INVENTION

An upright frame, mounted on a horizontal base, supports an electric motor and gear box having a drive shaft projecting vertically above the frame. An angular bracket, secured to the drive shaft, supports an axle coaxially projecting through a plate interposed between thrust bearings. The plate is provided with an axially off-set aperture loosely surrounding a vertical base supported rod for preventing angular rotation of the plate. The bracket and axle rotate as a unit relative to the plate.

A plurality of rows of radially spaced apertures, formed in the plate, support a plurality of strand mandrels. A like plurality of strands are connected at one end with the respective mandrels and are connected at their other ends with elements to be animated after passing through overhead supported pulleys. The strands are vertically reciprocated at their respective end portions by the plate and gravity when driven by a motor.

Principal objects of this invention are to provide an advertising display animation apparatus which is simple in construction and operation for imparting motion to one or more objects by flexible strands from a remote location, with a minimum amount of wear on the motion inducing strands, which requires no special tools or skill to install or operate resulting in a relatively long and useful life.

DESCRIPTION OF THE PREFERRED EMBODIMENT

Figure 1:
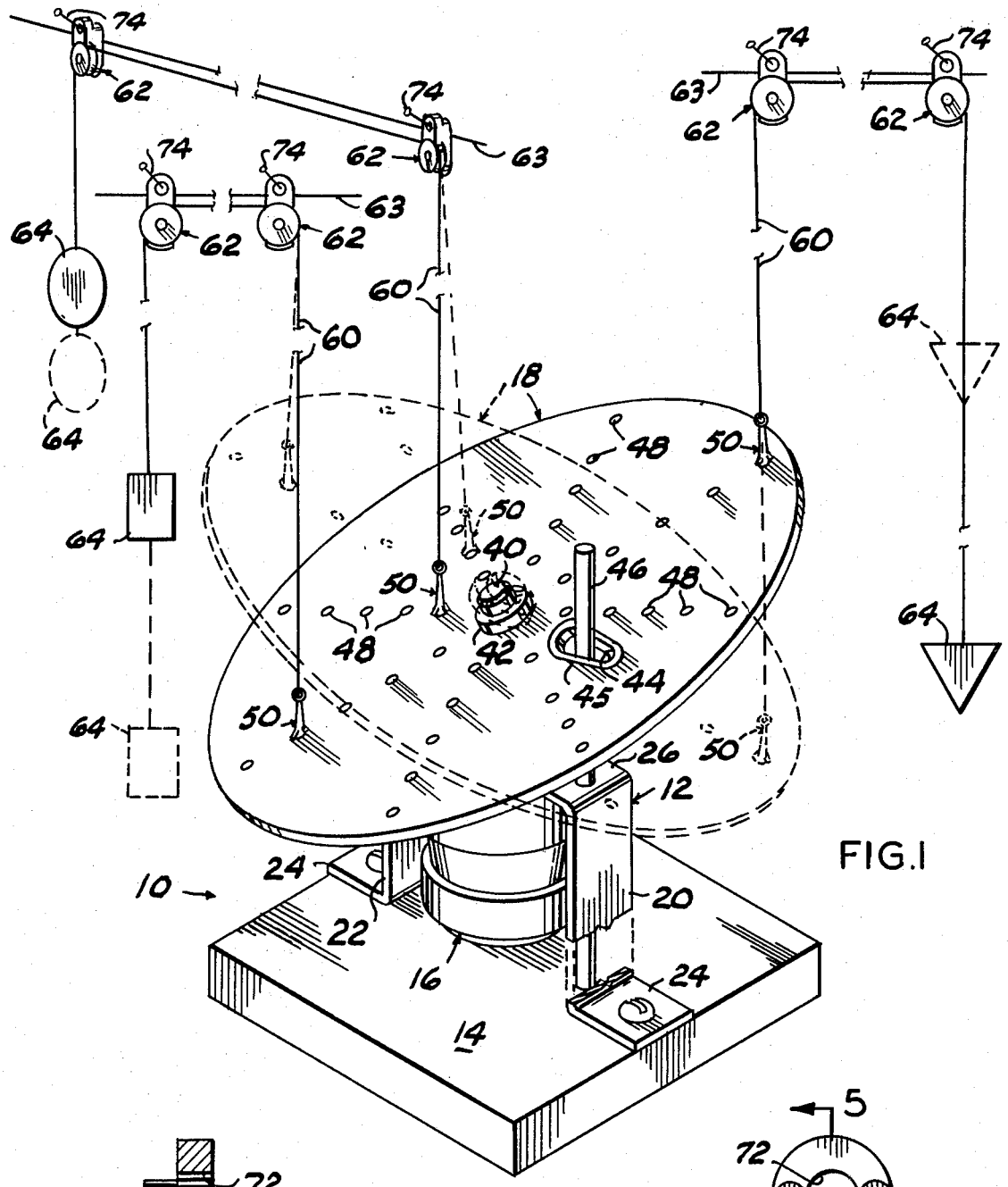
FIG. 1 is a perspective view of the apparatus with parts broken away for clarity and illustrating, by dotted lines, another position of the plate.
Figure 5:
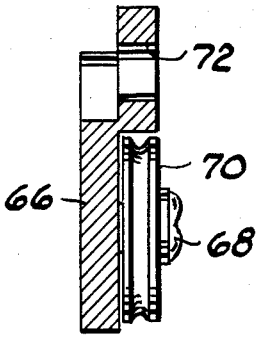
Figure 4:
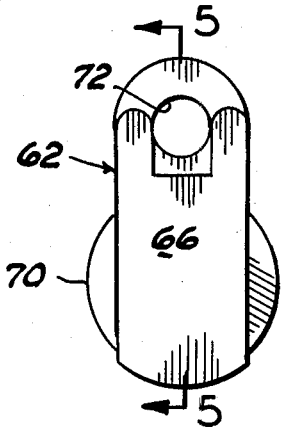
FIG. 4 is a back side elevational view, to a larger scale, of one of the strand support pulley blocks; and, FIG. 5 is a vertical cross sectional view, taken substantially along the line 5—5 of FIG. 4.
Figures 2, 3:
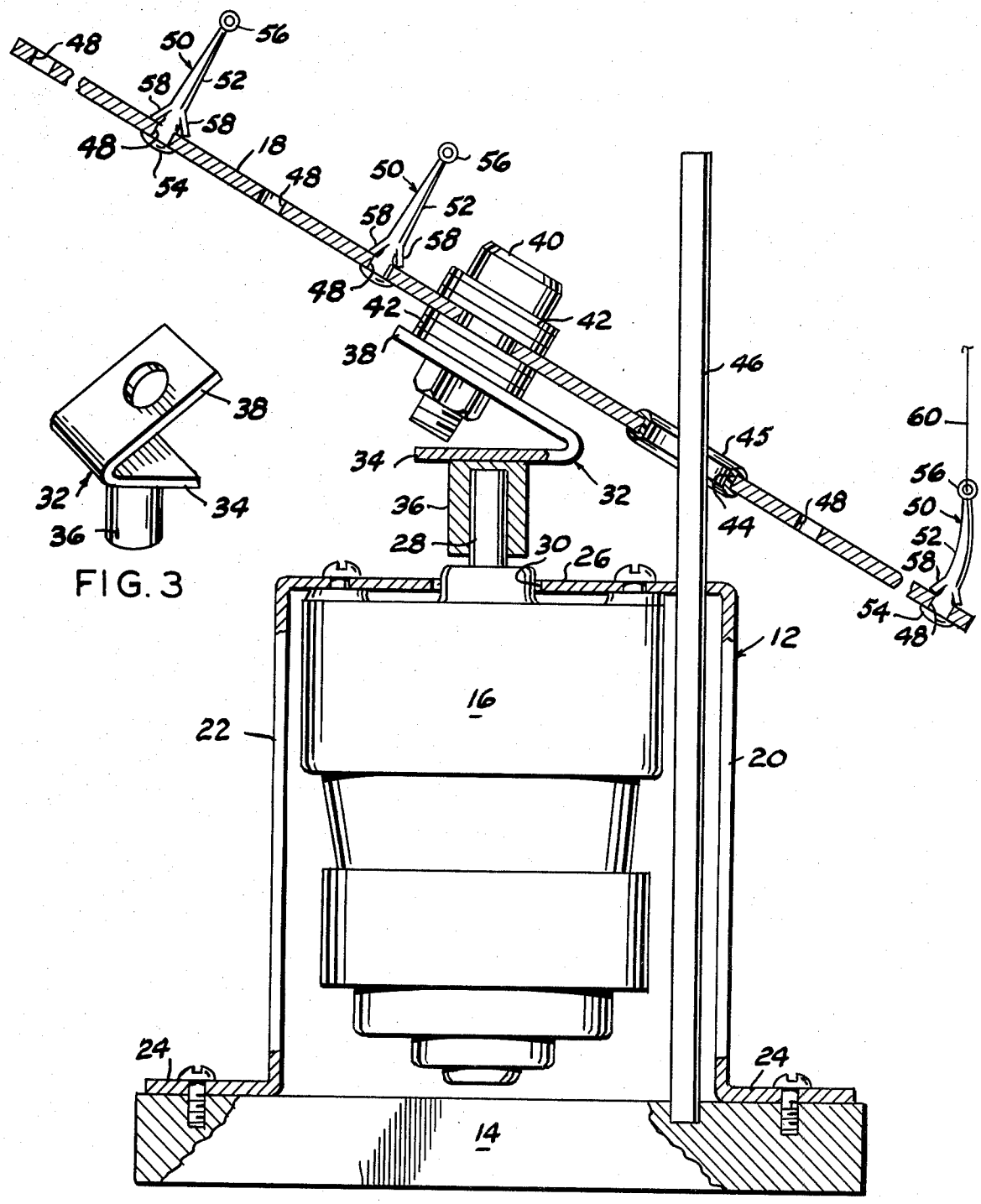
FIG. 2 is a fragmentary vertical cross sectional view, to a larger scale, partially in elevation, illustrating the plate in the dotted line position of FIG. 1.
FIG. 3 is a perspective view of the plate mounting bracket, per se.

Like characters of reference designate like parts in those figures of the drawings in which they occur.

In the drawings:

The reference numeral 10 indicates the device, as a whole, comprising an upright frame 12 mounted on a horizontal base 14 and supporting motor and gear train means 16 for oscillating a plate 18. Obviously the motor may be a variable speed type, if desired. The base 14 preferably comprising a section of plate stock having sufficient mass in combination with the motor means 16 to maintain the base flatly disposed on a supporting surface when the plate is connected with and supports elements or articles to be animated, as presently described.

In the example shown, the frame 12 is strap-like and formed to substantially describe an inverted U-shape having the depending end portions of its legs 20 and 22 turned laterally outward to form flanges 24 which are secured to upper opposing marginal edge surfaces of the base. The motor and gear train means 16 is supported by the frame bight portion 26 with the gear train having a drive shaft 28 disposed vertically and projecting through an aperture 30 formed in the frame bight portion. Bracket means 32 comprises an angular member having one of its legs 34 disposed normal to the axis of the drive shaft 28 and secured to a sleeve 36 coaxially surrounding the drive shaft and secured thereto as by a key or set screw, neither being shown, for rotation of the bracket means 32 about the axis of the drive shaft. The other leg 38 of the bracket means projects angularly upward in overlying relation with respect to its leg 34 and is secured to an axle means including a bolt and nut forming an axle 40 normal to the inclined plane of the leg 38.

The plate 18 is circular disk-like in the example shown, and is centrally apertured for journalling the axle 40. The axle means includes a pair of thrust bearings 42 interposed between respective opposing surfaces of the plate, the upper or head end of the bolt axle and the bracket leg 38, respectively, in surrounding relation with respect to the axle. Obviously, the plate could be of other peripheral configurations, if desired.

The plate 18 is provided with an axially off-set opening 44, having a friction reducing grommet 45 therein, for loosely surrounding a vertically disposed rod 46 projecting upwardly through the frame bight portion 26 and secured at its depending end to the base 14 for preventing angular rotation of the plate about the axis of the axle 40 when the bracket means 32 and axle 40 are rotated as a unit by the drive shaft 28. The plate opening 44 permits vertical reciprocating movement of the plate relative to the rod 36 when the bracket 32 is angularly rotated by the motor. The preferred arrangement and relative size of the components is such that the axis of the drive shaft intersects the central axis of the plate. Obviously, other means may be utilized for preventing angular rotation of the plate, for example, a pitman, not shown, may be supported by the base and connected by a ball joint with a peripheral portion of the plate or a radial rod-like extension on a peripheral portion of the plate guided by a vertical slot formed in an upright standard, not shown.

The plate is further provided with a plurality of radially spaced rows of apertures 48 for receiving a plurality of strand mandrels 50. The mandrels 50 are preferably formed from flexible material, such as plastic, and are characterized by a tapered shank portion 52 of selected length at least substantially greater than the thickness of the plate 18 terminating at one end in an enlarged head portion 54 and terminating at its other end in a generally circular closed loop 56. The mandrels are manually inserted into the plate apertures from the depending surface of the plate, as viewed in the drawings, and are further provided with one or more flexible lugs 58 adjacent its head 54 which engage the upper surface of the plate and maintain the mandrel head 54 adjacent the opposite or depending surface of the plate.

An elongated flexible, preferably monofilament, strand 60 is connected with the respective mandrel loop 56 and entrained intermediate its ends over one or more pulley means 62 supported by an overhead surface 63 and connected at its other end with a display element or elements 64 to be moved vertically or tilted in a rocking action in response to oscillating movement of the plate.

The pulley means 62 comprises an elongated block 66 having an integral shaft 58, at one end portion, journalling a pulley wheel 70. The opposite normally upwardly disposed end portion of the block 66 is provided with an off-set portion overhanging a peripheral portion of the pulley wheel in close spaced relation for preventing accidental removal of the strand 60 from the pulley wheel groove. The block 66 is further provided with an aperture 72 for receiving a nail 74 or other suitable pulley means support member.

OPERATION

The device 10 is preferably disposed in a normally out-of-sight or hidden position with respect to the elements 64 to be animated. When the motor means 16 is energized and angularly rotates the angular bracket means 32 at a predetermined rate the plate surfaces are moved vertically, as illustrated by the solid and dotted lines of FIG. 1, which vertically reciprocates the mandrel connected ends of the strands 60 and imparts like movement to the elements 64. The desired distance of movement to be imparted to the respective element 64 is predetermined and the strand 60 connected with one of the mandrels 50 located intermediate the length of a selected row of apertures 48 to limit movement of the element 64 to a desired dimension. Stated another way, maximum vertical movement of the element 64 is obtained when the strand 60 is connected with a mandrel 50 inserted within an outermost one of the plate apertures 48 and conversely, minimum vertical movement of the element 64 is obtained when the strand 60 is connected with a mandrel disposed in an aperture 48 adjacent the axis of the axle 40.

Obviously the invention is susceptible to changes or alterations without defeating its practicability. Therefore, I do not wish to be confined to the preferred embodiment shown in the drawings and described herein.

I claim:

1. An aminated display drive, comprising: a base;
motor means having a vertically disposed drive shaft supported by said base;
a plate;
axle means journalled by said plate on an axis inclined with respect to the axis of said drive shaft;
bracket means interposed between and connected with said drive shaft and said axle means;
means for preventing angular rotation of said plate with said drive shaft; and,
at least one flexible strand radially connected, at one end, with said plate and connected, at its other end, with an element to be animated.

2. The animated display drive according to claim 1 in which said bracket means includes:
an angle member having one leg disposed horizontally normal to the axis of said drive shaft and having its other leg angularly inclined upwardly in overlying relation with respect to said one leg and intersecting the axis of said drive shaft.

3. The animated display drive according to claim 2 in which said axle means comprises:
a bolt; and,
a pair of thrust bearings surrounding said bolt adjacent the respective opposing surfaces of said plate.

4. The animated display drive according to claim 3 in which said plate is provided with an axially off-set opening and said angular rotation preventing means comprises:
a rod verticaly projecting through the plate opening and supported by said base.

5. The animated display drive according to claim 4 in which said plate is characterized by a plurality of rows of radially spaced apertures and further including:
a plurality of mandrels received by the respective plate apertures,
each said mandrel having means for connecting said strand thereto.

6. The animated display drive according to claim 5 and further including:
at least one pulley block means supporting said strand intermediate its ends.

* * * * *